United States Patent [19]

Smith

[11] 4,101,745

[45] Jul. 18, 1978

[54] DRAWER OPERATED SWITCH ASSEMBLY

[75] Inventor: Gerald P. Smith, Dagsboro, Del.

[73] Assignee: NCR Corporation, Dayton, Ohio

[21] Appl. No.: 786,696

[22] Filed: Apr. 11, 1977

[51] Int. Cl.[2] ..... H01H 3/16

[52] U.S. Cl. ..... 200/61.61; 200/61.62; 235/22

[58] Field of Search ..... 200/61.61, 61.62; 235/22; 340/274

[56] References Cited

U.S. PATENT DOCUMENTS

| | | | |
|---|---|---|---|
| 3,061,185 | 10/1962 | Richard | 235/22 |
| 3,855,432 | 12/1974 | Kelly et al. | 200/61.62 X |

OTHER PUBLICATIONS

Berkman, J. W.; IBM Tech. Disc. Bull.; Multiple Cash Drawer Control; vol. 10, No. 12, May 1968; pp. 1928, 1929.

Burnham, D. W.; IBM Tech. Disc. Bull.; Release Mechanism for Spring Loaded Plunger; vol. 14, No. 12, May 1972.

Best, J. J. et al.; Self-Restoring Latch/Unlatch Mechanism for Logic Controlled Drawer; vol. 17, No. 7, Dec. 1974.

*Primary Examiner*—James R. Scott

*Attorney, Agent, or Firm*—J. T. Cavender; Wilbert Hawk, Jr.; Richard W. Lavin

[57] ABSTRACT

A latch mechanism is disclosed for latching a cash drawer of a data terminal device in a closed position and for generating an electrical signal indicating the position of the drawer within the terminal device. The latching mechanism includes a rotatable latch member having a latching portion normally positioned out of the line of movement of a drawer catch member. Movement of the drawer to a closed position results in the catch member engaging and rotating the latch member wherein the latching portion is moved into a latching position with the catch member allowing a blocking member to hold the latch member in the latched position, the blocking member operating a switch for generating an electrical signal indicating the latching of the cash drawer.

16 Claims, 3 Drawing Figures

DRAWER OPERATED SWITCH ASSEMBLY

BACKGROUND OF THE INVENTION

In electronic cash registers or other data terminal devices which are employed in merchandising checkout operations, the release of the cash drawer from a closed position to allow for the disbursement of change is conditioned on the operation of certain control keys on the keyboard of the terminal device. Before the checkout operation can continue, the terminal device must be notified that the cash drawer has been returned to its closed position. Prior latching mechanisms which generate a signal upon the latching of the cash drawer in a closed position have utilized complicated structural arrangements to actuate a switch only after the cash drawer has been latched in a closed position. One example of such a latching mechanism is disclosed in U.S. Pat. No. 3,855,432 assigned to the assignee of the present application. While this type of latching mechanism operates satisfactorily, it has been found that the latch member requires precise adjustments with respect to the drawer catch to function properly, which adjustments are hard to hold due to the camming movement of the latch member by the drawer catch prior to the latching of the drawer catch. This condition has resulted in a high failure rate of the operation of the latch mechanism. It is therefore a principal object of this invention to provide a latch mechanism in which the latching mechanism is actuated by the initial contact of the drawer with the latching mechanism upon movement to a closed position. It is another object of this invention to provide a latching mechanism which is moved into a positive latching engagement with the drawer upon the engagement of the latching mechanism by the drawer. It is a further object of this invention to provide a latching mechanism which is of simple construction, low in cost and which requires no adjustment for its satisfactory operation. It is another object of this invention to provide a latch mechanism constructed to be released from the keyboard of the terminal device. It is still a further object of this invention to provide a latching mechanism which will generate a signal indicating the position of the cash drawer.

SUMMARY OF THE INVENTION

In accordance with the teachings of the present invention, there is provided a latch member having a forwardly positioned latch portion, the latch portion being moved into a latching position upon rotation of the latch member in an actuated direction, the latch member being pivotally mounted for rotation in an actuated direction by a catch member, secured to the cash drawer, upon movement of the cash drawer to a closed position; a pivotally mounted blocking member which is moved, upon rotation of the latch member to a latching position, into a position to hold the latch member in the latching position; a switch member actuated by the blocking member in moving to a holding or blocking position; and a solenoid engaging the blocking member to rotate the blocking member from the holding or blocking position allowing the latch member to be rotated to an unlatched position under the operation of a resilient member engaging the latch member.

DESCRIPTION OF THE PREFERRED EMBODIMENT

Figure 1:
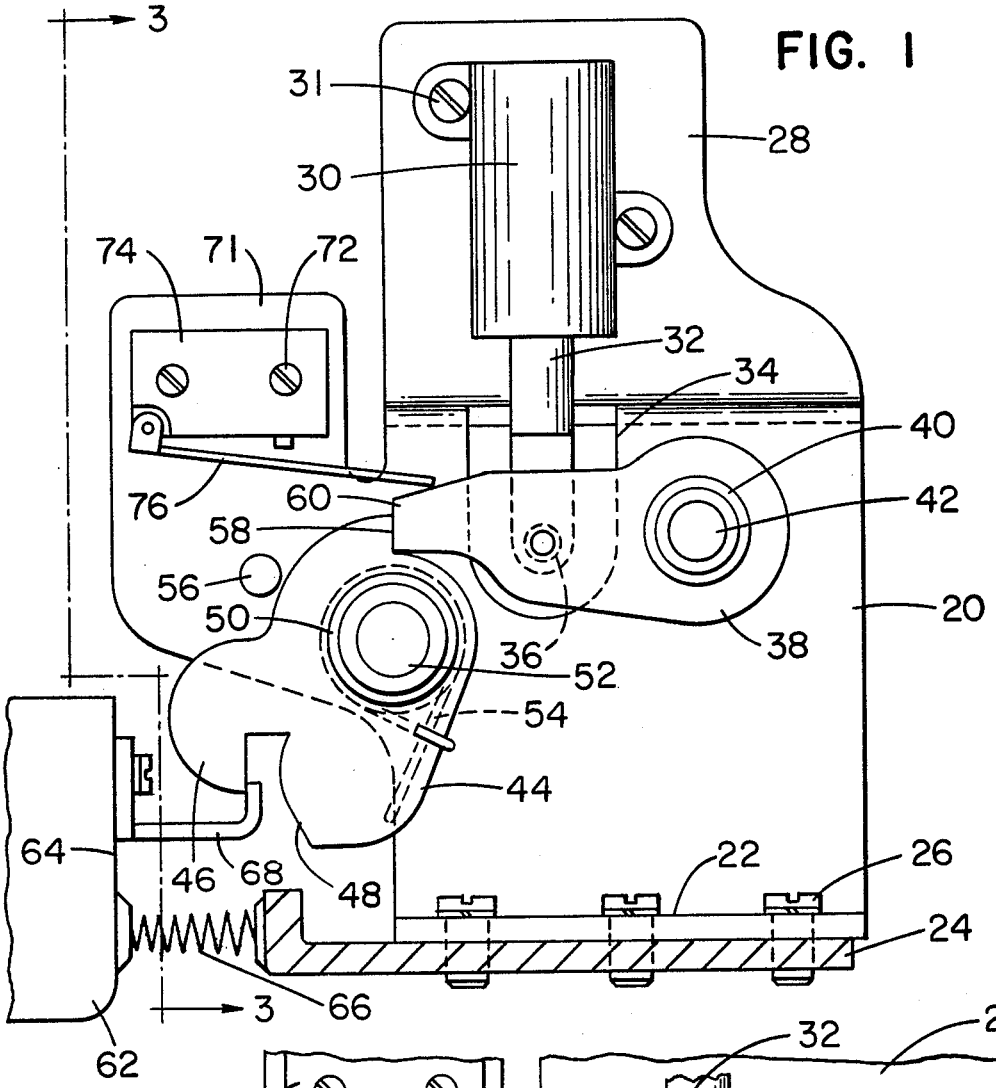
FIG. 1 is a side view of the latching mechanism in accordance with the present invention showing the mechanism in a latched position.
Figure 2:
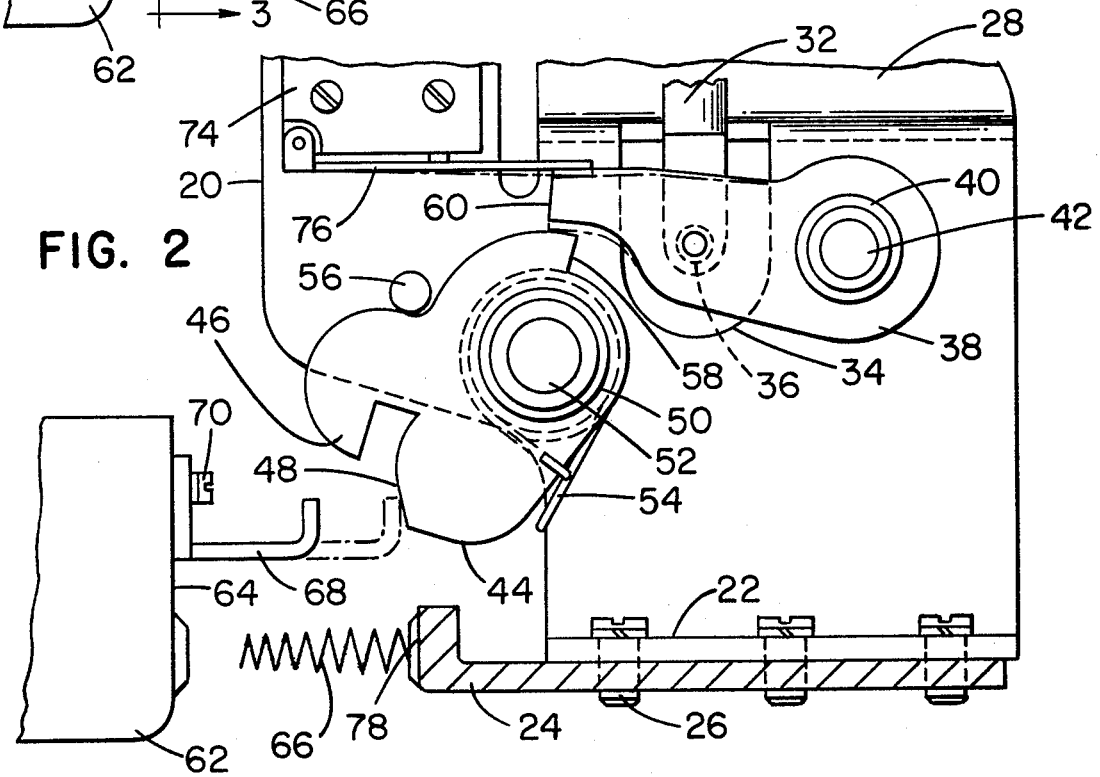
FIG. 2 is similar to FIG. 1 showing the latching mechanism in an unlatched position.
Figure 3:
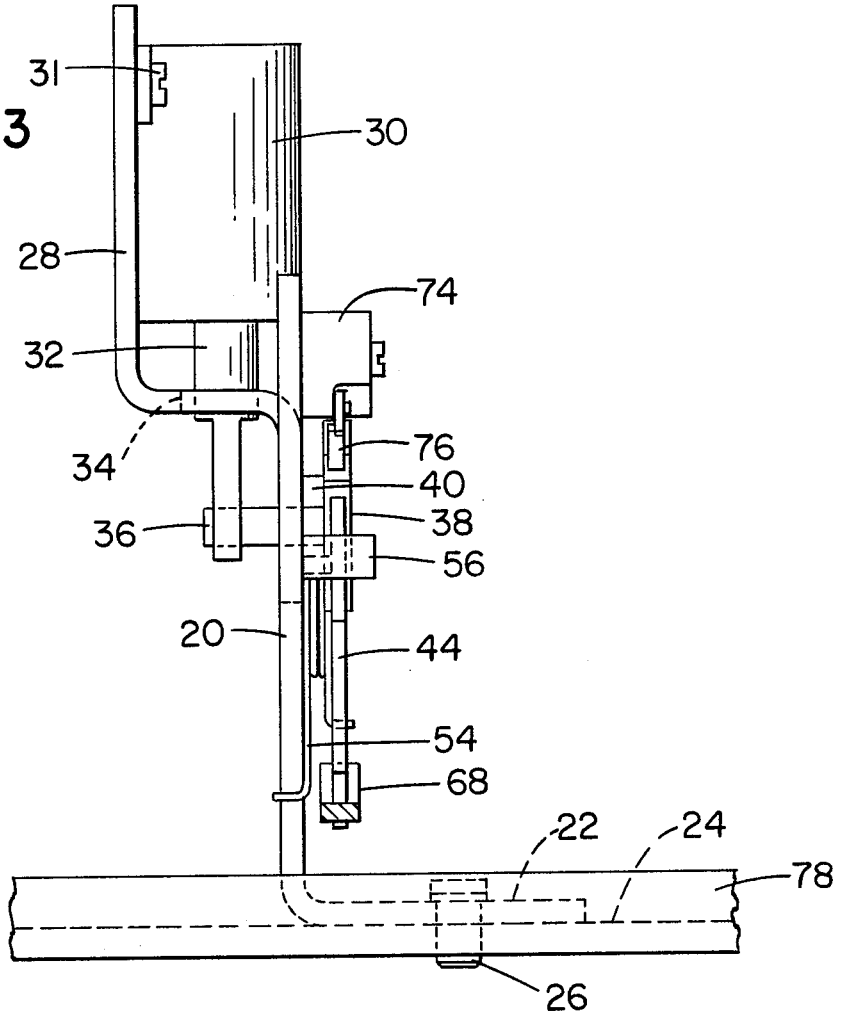
FIG. 3 is a view taken on line 3—3 of FIG. 1 showing a front view of the latching mechanism.

Referring to FIGS. 1 and 2, there is shown a side view of the latching mechanism constructed in accordance with the present embodiment which includes a support bracket 20 having a flange portion 22 secured to a support member 24, which support member may be a portion of the terminal device, by any suitable fastening means such as screws 26. As shown more clearly in FIG. 3, the bracket 20 has an L-shaped upper portion 28 to which is mounted, by means of screws 31, a solenoid 30 whose armature 32 extends downwardly into a cutout portion 34 (FIGS. 1 and 2) located in the bracket 20. While the present embodiment incorporates the use of a separate bracket 20 as a support member, it is obvious that a portion of the terminal device housing itself may be utilized for the same purpose.

Secured to the lower end of the armature 32 is a stud 36, the outer end of which is rotatably connected to an elongated blocking member 38 located adjacent the bracket 20 and having mounted thereon a hub member 40 which is rotatably mounted on a stud 42 secured to the bracket 20. It will be seen from this construction that operation of the solenoid 30 results in the armature 32 rotating the blocking member 38 between a fully extended position shown in FIG. 1 and a retracted position shown in FIG. 2.

Positioned adjacent the front end of the blocking member 38 (left end as viewed in FIGS. 1 and 2) is a latch member 44 having a hook portion 46 comprising the front edge of the latch member 44 and including a lower receding cam edge or surface 48 positioned below and downstream of the hook portion 46. A hub member 50 secured to the latch member 44 is rotatably mounted on a stud 52 secured to the bracket 20. Positioned on the stud 52 is a torsion spring 54 having one end engaging the front edge of the bracket 20 while its other end engages the rear edge of the latching member 44 to thereby normally bias the latching member 44 in a clockwise direction as viewed in FIGS. 1 and 2, which movement is limited by a stud 56 mounted on the bracket 20 and which is positioned in the path of the clockwise movement of the hook portion 46 of the latch member 44. The latching member 44 also includes an upstanding stop edge 58, which as will be described more fully hereinafter, coacts with the front or left edge 60 of the blocking member 38 allowing the blocking member to hold the latch member 44 in a latching position.

As best understood from FIGS. 1 and 2, the bracket 20 is positioned in the path of movement of the cash drawer 62 of the data terminal device. Secured to the rear edge 64 of the cash drawer 62 is a rearwardly extending spring member 66 and an L-shaped catch member 68, the latter secured to the rear edge 64 by means of screws 70. The catch member 68 is oriented on the cash drawer so as to engage the cam surface 48 of the latch member 44 upon the movement of the cash drawer 62 towards a closed position.

As shown in FIG. 1, secured to a front portion 71 of the bracket 20 by means of any suitable fastening means, such as screws 72, is a switch member 74 having a rearwardly extending snap action switch actuator member 76 whose free end engages the top edge of the blocking member 38. The actuator member 76 is mounted on the latch member 74 such that rotation of the actuator member 76 is a counter-clockwise direction will activate the switch member 74 while movement thereof in a clockwise direction will deactivate the switch member 74. In the present embodiment, the switch member 74 is activated during the time the cash drawer is not in a latched position and is deactivated upon the latching of the cash drawer in a closed position. It is obvious that the signals generated by the opening and closing of the switch member 74 can be utilized in any manner to indicate the position of the cash drawer within the terminal device.

In operation, the latch member 44 is normally in a latched position as shown in FIG. 1. In this position, the hook portion 46 of the latch member 44 engages the catch member 68 and thereby holds the cash drawer 62 in a closed position. The latch member 44 is maintained in this latched position by the blocking member 38 whose left edge portion 60 is positioned by the downward movement of the armature 32 upon the deenergizing of the solenoid 30 behind the stop edge 58 of the latch member 44 — the latch member 44 being urged at this time in a clockwise direction by the action of the torsion spring 54.

During a sales transaction in which the cash drawer 62 is required to be opened, the solenoid 30 is energized as a result of a functional operation performed by the terminal device. Energizing of the solenoid 30 results in the retraction (raising) of the armature 32, thereby rotating the blocking member 38 clockwise from the position of FIG. 1 to release the latch member 44 to the action of the torsion spring 54. The torsion spring 54 will rotate the latch member 44 clockwise to the position shown in FIG. 2 where the latch member engages the stud 56. In this position, the catch member 68 is released allowing the cash drawer 62 to be moved to an open position by the action of the spring 66. The clockwise rotation of the blocking member 38 also results in counter-clockwise rocking of the actuator member 76, thus closing of the switch member 74 and thereby providing a signal indicating the unlatching of the cash drawer 62. The solenoid 30 is then deenergized resulting in the moving of the armature 32 in a downward direction due to the weight of the armature 32 and the blocking member 38, thereby positioning the left edge portion 60 of the blocking member 38 against the top edge of the latch member 44, as shown in dotted lines in FIG. 2. As will be described more fully hereinafter, counter-clockwise rotation of the latch member 44 will result in the edge 60 of the blocking member 38 dropping down behind the stop edge 58 of the latch member 44. Upon clockwise movement of the latch member 44 as a result of the action of the spring 54, the left edge 60 of the blocking member 38 will engage the stop edge 58 of the latch member 44 thus holding the latch member 44 in a latched position. While the counter-clockwise movement of the blocking member 38 has been described as occurring due to the weight of the armature 32 and the blocking member 38, it is obvious that the same movement can be accomplished by connecting a return spring member between the blocking member 38 and the bracket 20 in a manner so as to normally urge the blocking member in a counter-clockwise direction.

At the completion of the change dispensing or other type of terminal operation requiring the cash drawer 62 to be opened, the cash drawer is manually moved inwardly (to the right in FIG. 2) towards a closed position by the operator. As the drawer 62 approaches the latching mechanism, the spring 66 will engage a flange portion 78 of the support member 24. The drawer catch 68 will then engage the cam surface 48 of the latch member 44 rotating the latch member counter-clockwise against the action of the torsion spring 54, thereby moving the hook portion 46 of the latch member 44 down behind the catch 68 (FIG. 1). Upon the latch member 44 being so rotated counter-clockwise, the left edge 60 of the blocking member 38 will drop down behind the stop edge 58 of the latch member 44 in the manner described previously.

Upon release of the cash drawer 62 by the operator after the catch 68 thereof has so rotated the latching member 44, the torsion spring 54 will return the latch member 44 clockwise to the position shown in FIG. 1 where the latch member 44 is held by the blocking member 38. The spring 66 will also urge the cash drawer 62 outwardly until the catch 68 engages the hook portion 46 as shown in FIG. 1, thereby latching the cash drawer 62 in its closed position. The spring 66 will thus hold the drawer 62 in the latched position. The counter-clockwise movement of the blocking member 38 upon the rotation of the latch member 44 by the catch 68 allows the switch actuator arm 76 to rotate clockwise, thus deactivating the switch 74 and thereby signalling the data terminal device that the cash drawer 62 is in a latched position.

It will be seen from this construction that once the latch member 44 has been rotated in a counter-clockwise direction sufficiently to allow the blocking arm 38 to move into a blocking position with the stop edge 58 of the latch member 44, the hook portion 46 of the latch member 44 has been moved to a latching position with respect to the drawer catch 68. Since this latching movement is solely the result of the location of the hook portion 46, the cam surface 48 and the stop edge 58 of the latch member, it is obvious that no adjustments are required in order that the latching mechanism function for its intended purpose. It is further obvious that since the latching mechanism comprises essentially the latch member 44 and the blocking member 38 together with the torsion spring 54, the cost of such a mechanism is relatively low with very little wear occurring and thereby insuring a long operating life of the latching mechanism.

While the principal of the invention has now been made clear in an illustrated embodiment, it will be obvious to those skilled in the art that many modifications of structure in arrangements of elements and components can be made which are particularly adapted for specific environments and operating requirements without departing from these principals. The appended claims are therefore intended to cover any such modifications within the limits of the true spirit and scope of the invention.

What is claimed is:

1. In combination with an enclosure structure including a slidably mounted drawer having an engaging member secured thereto, means for generating a signal upon latching of the drawer in a closed position within the enclosure structure comprising:

(a) latching means movably secured to said enclosure structure and positioned in the plane of movement of the drawer engaging member, said latching means being moved to a latching position by the engaging member upon movement of the drawer in a drawer closing position;

(b) signal generating means mounted on said enclosure for generating a signal when operated;

(c) and holding means operatively associated with said signal generating means and mounted for movement to a position holding said latching means in a latching position when so moved thereto by movement of said drawer to a closed position, said holding means operating said signal generating means upon movement thereof to the latching means holding position.

2. The latch mechanism of claim 1 in which said latching means comprises a latch member rotatably mounted on said enclosure structure, said engaging member rotating said latch member upon movement of the drawer to its closing position, and said latch member including a latching portion for latching said engaging member upon rotation of the latch member thereby to a latching position.

3. The latch mechanism of claim 1 further including selectively operable actuating means engaging said holding means for removing said holding means from a holding position with said latching means, and means engaging said latching means for normally urging said latching means to a non-latching position whereby said latching means is returned to a non-latching position upon the removal of said holding means from a holding position with said latching means.

4. The latching mechanism of claim 2 in which said latch member includes a recessed portion position adjacent said holding means, and said holding means comprises a blocking member rotatably mounted adjacent said latch member for movement to a position engaging said recessed portion upon movement of the latch member to a latching position whereby said engaging member is held in a latched position with said latch member by said holding member.

5. The latch mechanism of claim 2 in which said latch member further includes an engaging portion positioned in the path of movement of said engaging member for effecting rotation to said latch member through engaging said engaging member upon movement of the drawer to a drawer closing position, said engaging portion positioned downstream of said latching portion whereby upon the engaging and rotation of said latch member by said engaging member, said latching portion is moved into a latching position with said engaging member.

6. The latch mechanism of claim 5 in which said latching portion of said latch member comprises a recessed portion located upstream and above said engaging portion whereby said engaging member will move freely past said recessed portion before engaging said engaging portion, thereby allowing the recessed portion to latch said engaging member upon rotation of the latch member to a latching position.

7. The latch mechanism of claim 3 in which said urging means comprises a spring member engaging said latching means for normally urging the latching means to a non-latching position.

8. In a data terminal device having a drawer slidably mounted for movement between an open and closed position, a mechanism for generating a signal indicating the closed position of the drawer comprising:

(a) engaging means carried by the rear of said drawer;

(b) a movable latch member mounted in the path of movement of said engaging means, said latch member being moved from a non-latching position to a position latching the engaging means upon movement of the drawer to a drawer closing position;

(c) a blocking member normally engaging said latch member in a non-blocking position, said blocking member moving into a blocking position upon movement of the latch member to a latching position to block return movement of the latch member to a non-latching position;

(d) switching means for generating a signal when actuated;

(e) switch operating means engaging said switching means and said blocking member for operating said switching means when actuated, said means being activated upon movement of said blocking member to a blocking position;

(f) and means engaging said latch member for continuously urging said latch member in a non-latching direction, said urging means moving said latch member into engagement with said blocking member upon movement of the latch member to a latching position.

9. The signal generating mechanism of claim 8 which further comprises resilient means engaging and normally urging the drawer in a drawer open direction upon movement of the drawer to a closed position, said resilient means moving the drawer in a drawer open direction to release the latch member to the action of said urging means whereby said latch member is moved in engagement with said blocking member.

10. The signal generating mechanism of claim 8 in which said latch member includes an abutment portion located in the path of movement of said engaging means and a latching portion located out of the path of movement of said engaging means, said engaging means engaging the abutment portion of the latch member upon movement of the drawer to a closed position whereby the latch member is moved to position the latching portion in a latching position with said engaging means.

11. The signal generating mechanism of claim 8 in which said latch member includes a blocking portion positioned adjacent said blocking member, said signal generating mechanism further comprises means operatively associated with said blocking member for moving said blocking member into a position adjacent said blocking portion whereby said urging means moves the blocking portion of said latch member into engagement with said blocking member to position the latch member in a latching position.

12. The signal generating means of claim 10 in which said latch member latching portion comprises a recessed portion located upstream and above said abutment portion whereby upon movement of the drawer to a closed position, said engaging means will move past said recessed portion before engaging said abutment portion thereby allowing the recessed portion to latch said engaging means upon movement of the latch member thereby to a latching position.

13. The signal generating means of claim 11 in which said switch operating means comprises an arm member secured to said switching means and extending to a position engaging said blocking member, said arm member being moved to operate said switching means by the movement of said blocking member to a position adjacent the blocking portion of said latch member.

14. The signal generating means of claim 8 further comprising a selectively operable actuating means engaging said blocking member, said actuating means adapted for moving said blocking member into a blocking position with said latch member when in a non-operated condition and removing said blocking member from said blocking position when operated.

15. A method for generating a signal indicating the latched position of a drawer within a data terminal device comprising the steps of (a) moving the drawer in a drawer closing direction into engagement with a latch mechanism;

(b) moving the latch mechanism into a latching position with said drawer upon engagement of the drawer with the latch mechanism;

(c) moving a blocking member into engagement with said latch mechanism upon movement of the latch mechanism into a latching position;

(d) and actuating a switch during movement of the blocking member into engagement with said latch mechanism to generate a signal indicating the latched position of the drawer.

16. In a housing which slidably supports a drawer member between an open and closed position wherein the drawer has an engaging member, a switch actuating latch mechanism for latching the drawer in a closed position comprising:

(a) a latch member pivotally mounted to said housing having a cam portion positioned in the path of movement of the engaging member and having a latching portion, said cam portion being moved by said engaging member to a latching position upon movement of the drawer to a closed position wherein said latching portion is moved to latch said engaging member;

(b) a blocking member pivotally mounted to said housing and positioned adjacent said latch member;

(c) means operatively associated with said blocking member for normally urging said blocking member into engagement with said latch member, said blocking member being moved by said urging means into a blocking engagement with said latch member upon movement of the latch member to a latching position;

(d) a signal generating switch member positioned adjacent said blocking member;

(e) and a movable switch operating member engaging said switch member and operatively associated with said blocking member for movement thereby, said switch operating member being moved by said blocking member in a direction to operate said switch member upon movement of the blocking member into blocking engagement with said latch member for operating said switch member whereby a signal is generated upon the latching of the drawer by said latch member.

* * * * *